US005554838A

United States Patent [19]

Berdich

[11] Patent Number: 5,554,838

[45] Date of Patent: Sep. 10, 1996

[54] HAND-HELD HEATING TOOL WITH IMPROVED HEAT CONTROL

[75] Inventor: Edward C. Berdich, Downingtown, Pa.

[73] Assignee: Wind Lock Corporation, Birdsboro, Pa.

[21] Appl. No.: 518,232

[22] Filed: Aug. 23, 1995

[51] Int. Cl.[6] ..... H05B 1/02; H05B 3/00

[52] U.S. Cl. ..... 219/240; 219/492; 219/509

[58] Field of Search ..... 219/240, 241, 219/221, 250, 492, 501, 508, 509; 30/140; 83/15, 16, 170, 171; 228/51

[56] References Cited

U.S. PATENT DOCUMENTS

| | | | |
|---|---|---|---|
| 3,373,262 | 3/1968 | Howell . | |
| 4,527,560 | 7/1985 | Masreliez | 219/233 |
| 4,604,517 | 8/1986 | Barry | 219/494 |
| 4,660,057 | 4/1987 | Watanabe et al. | 219/501 |
| 4,906,901 | 3/1990 | Carroll . | |
| 5,270,520 | 12/1993 | Barzilai et al. | 219/501 |
| 5,416,300 | 5/1995 | Hickl et al. | 219/492 |
| 5,421,943 | 6/1995 | Tam et al. | 156/273.9 |

FOREIGN PATENT DOCUMENTS

| | | | |
|---|---|---|---|
| 748225 | 8/1970 | Belgium | 219/241 |
| 2746097 | 4/1979 | Germany | 219/241 |
| 3228202 | 2/1984 | Germany | 219/241 |
| 3406966 | 8/1985 | Germany . | |

OTHER PUBLICATIONS 3 pgs. of literature describing Electronic Transformers of Hatch Transformers Inc. (date unknown).

1 sheet of drawing (undated) showing the Hatch circuit.

Wind–Lock Corporation Hot Groover Brochure (date unknown).

*Primary Examiner*—John A. Jeffery

*Attorney, Agent, or Firm*—Howson and Howson

[57] ABSTRACT

A hand-held groover for forming grooves, bevels, etc. in architectural insulation board comprises a resistive cutting blade, a 25 KHz. oscillator, operated by full-wave rectified line current and connected to the cutting blade through a light-weight transformer. The oscillator delivers to the heating element a sequence of electrical pulses synchronized with the line current frequency, each having a duration of 1/120 second. Each pulse consists of plural oscillations at 25 KHz., so that the heating current in the blade is essentially an amplitude-modulated 25 KHz. current. The modulating pulses are selected from the continuous train of 120 Hz. pulses by an adjustable triggering circuit, to adjust the time interval between pulses and thereby control the temperature of the heating element.

8 Claims, 2 Drawing Sheets

HAND-HELD HEATING TOOL WITH IMPROVED HEAT CONTROL

BRIEF SUMMARY OF THE INVENTION

This invention relates generally to electrically energized, hand-held tools for heat application, and more particularly to improvements whereby the tools are made lighter in weight. It has particular utility in hot groovers used to cut grooves, bevels, reveals and control joints in rigid insulation board used on building exteriors.

In recent years exterior insulation has come into increasing use in both residential and commercial building exteriors. A typical exterior finish comprises a layer of architectural insulation board, a metal reinforcing mesh embedded in a base coat, and an acrylic-based exterior finish. The insulation board is typically expanded or extruded polystyrene or rigid polyisocyanurate.

To produce an aesthetically pleasing appearance in an otherwise flat exterior finish, grooves, bevels, reveals and other features are formed in the insulation board before the base coat, reinforcing mesh, and exterior finish layer are applied. These grooves are typically formed by a hot groover, a hand-held tool having replaceable blades which are electrically heated and which are designed to cut grooves, bevels and the like, of the desired cross-section in the insulation board.

The hot groover is typically used to form grooves, bevels, reveals and control joints in insulation boards already mounted in their final positions at a job site. Thus, the operator needs to be able to move about the job site while using the hot groover.

Conventional hot groovers utilize blades made of a low temperature carbon steel, having a low electrical resistance, e.g. in the vicinity of 1 ohm. A typical blade material is PYROMET alloy A-286, available from Carpenter Technology Corporation. The blade is heated by applying an electrical potential directly across the blade to produce an electrical current in the blade from one end to the other. In order to produce the low voltage and high current required to heat the low-resistance blade, it has been necessary to use a transformer to convert the available line voltage (typically 120 volts in the U.S.) to a much lower voltage (e.g. 14 volts). Because of the requirement for an iron core in an efficient electrical transformer, the transformer is necessarily heavy and it is not practical to incorporate the transformer into the hand-held tool.

The heavy current drawn by the blade also requires heavy conductors between the transformer and the blade. It is not practical to provide a long cable between the transformer and the tool because the cable would be too heavy and unwieldy. Furthermore, it would be necessary to pick up and move the transformer frequently in the process of grooving insulation boards on a job site. Another problem is that the operator needs to be able to control the current in the blade to adjust the blade temperature. This is not easy to accomplish at very low voltages and heavy current levels at the location of the hand-held tool, and it is not practical to provide the necessary controls at the location of a transformer remote from the tool.

Because of the foregoing considerations, conventional grooving tools have utilized belt-carried transformers and controls. The belt-carried electrical components are connected to the 120 volt line current source through a long, relatively light weight cable, while the hand-held unit is connected to the belt-carried transformer by a relatively heavy, but short cable, only several feet in length. This allows the operator to move about the job site while forming grooves, bevels and the like in mounted insulation boards.

Although a hot groover using a belt-carried transformer and control allows the operator to move about, it is still heavy, cumbersome and somewhat inconvenient to use.

The principal object of this invention is to provide an improved hand-held hot groover which is light in weight and which can be supplied with electrical current through a light-weight electrical cable.

Another object of the invention is to provide a hand-held hot groover which is more convenient for the operator to use.

Still another object of the invention is to provide a hot groover in which the blade temperature is easily adjusted and accurately controlled.

To address these objects, the preferred hand-held heating tool in accordance with the invention comprises a resistive heating element, means for receiving alternating line current at a first frequency, means, comprising an oscillator connected to the line current receiving means and to the resistive heating element, for producing an alternating current in the resistive heating element at a second frequency higher than the first frequency, and delivery and control means for causing the oscillator to deliver to the heating element a sequence of electrical pulses, each pulse consisting of plural oscillations at the second frequency, and for adjusting the time intervals between the pulses to control the electrical energy dissipated by the resistive heating element and thereby control the temperature of the heating element.

Further objects, advantages and details of the invention will be apparent from the following detailed description, when read in conjunction with the drawings.

DETAILED DESCRIPTION

Figure 1:
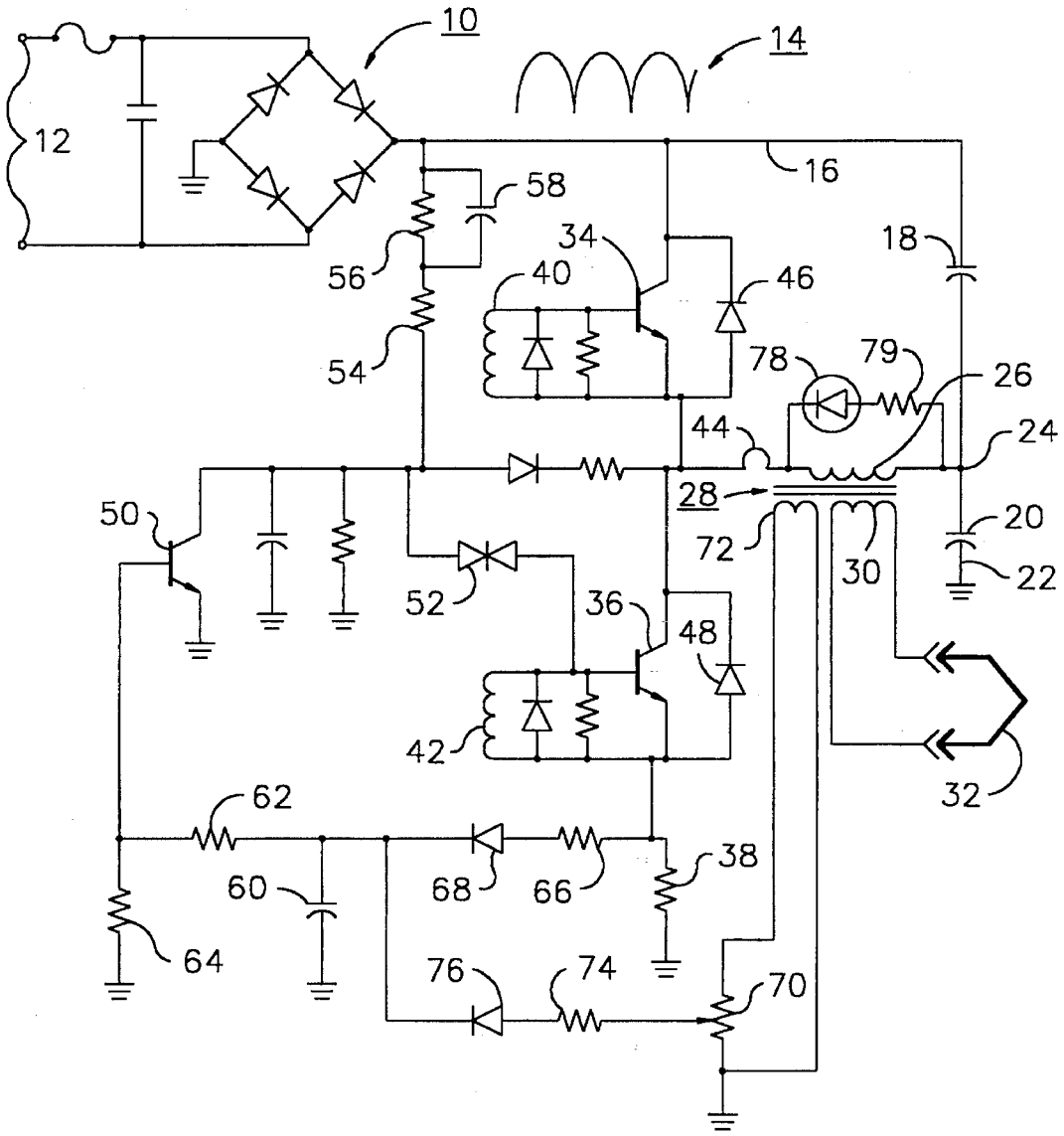
FIG. 1 is an schematic diagram showing the electrical circuitry of a preferred hot groover in accordance with the invention.

The circuit of FIG. 1 is contained entirely in the hand-held groover unit, and comprises a full wave diode bridge rectifier 10 receiving 60 Hz. line current from terminals 12, and delivering approximately sinusoidal pulses 14, repeating at a rate of 120 Hz., to line 16.

Capacitors 18 and 20 are connected in series between line 16 and the device ground 22, and the junction 24 between the capacitors is connected to one end of the primary winding 26 of a step down transformer 28. A secondary winding 30 of transformer 28 is connected to a low-resistance groover blade 32, formed to a desired configuration to cut a groove of a desired shape in insulation board. As will be apparent from the following discussion, transformer 28 operates at a frequency of 25 KHz. and therefore requires only a small amount of iron in its core. It can therefore be made much lighter in weight than a transformer of similar power handling capabilities operating at 60 Hz.

Also connected in series between line 16 and the device ground are the collector-emitter circuits of pair of NPN transistors 34 an 36 and a resistor 38. The emitters of transistors 34 and 36 are driven by secondary windings 40 and 42 respectively of a toroidal pulse transformer having an excitation winding 44 in series with the primary of step-down transformer 28. The opposite terminal of the excitation winding 44 is connected to the junction between the emitter of transistor 34 and the collector of transistor 36. Protective diodes 46 and 48 are provided across the emitter-collector circuits of the two transistors.

Transistors 34 and 36 are connected in a complementary circuit, which can be triggered into oscillation by a current pulse applied to the base of transistor 36. Transistors 34 and 36 conduct alternately by virtue of the operation of the pulse transformer. Thus, when transistor 36 goes into conduction, it produces a current in a first direction in the excitation winding 44. This current causes a current in winding 40, which causes transistor 34 to conduct and at the same time produces a current in winding 42 which cuts off transistor 36. When transistor 34 conducts, the current in the excitation winding reverses direction, and the opposite effect takes place: transistor 36 goes into conduction, and transistor 34 is cut off. Thus, the two transistors oscillate, producing a high frequency alternating current (e.g. at 25 KHz.) not only in the excitation winding 44, but also in the primary winding 26 of the step-down transformer 28. The oscillation frequency, of course, depends upon the characteristics of the pulse transformer and the resistances in the transistor circuits.

The voltage in line 16, goes to zero every 1/120 th of a second, and the oscillation of the complementary transistor circuit depends upon the presence of a voltage in line 16. The oscillator circuit is not self-triggering. Therefore, for oscillations to take place during any given 120 Hz pulse, a triggering signal must be given for that pulse. The requirement for a separate triggering signal for each pulse makes it possible to skip pulses, that is to cause oscillations only for some of the 120 Hz pulses and not for others. Thus, the current in the groover blade 32 can be controlled by selective triggering.

The triggering circuit comprises a transistor 50, the collector of which is connected to the base of transistor 36 through a bidirectional trigger diode 52, which conducts and provides a triggering pulse to transistor 36 at a triggering voltage of, for example, 30 volts. The collector of transistor 50 is connected, through a diode 53 and resistor 55, to the junction of the emitter of transistor 34 and the collector of transistor 36. These elements provide a bias to insure proper starting of the oscillator.

The collector of transistor 50 is connected to line 16 (the output of rectifier 10) through resistor 54 in series with the parallel combination of resistor 56 and capacitor 58. The condition of transistor 50 is determined by its base current, which is a function of the charge held by capacitor 60. Capacitor 60 is connected to the base of transistor through a resistor 62, and the base is connected to the device ground through a resistor 64. The charge held by capacitor 60 is determined by two feedback circuits. One of these feedback circuits comprises resistor 66 and diode 68, which are connected between the capacitor and the junction of resistor 38 and the emitter of transistor 36. The other feedback circuit comprises a variable resistor 70, the ends of which are connected across an auxiliary secondary winding 72 of transformer 28, and the wiper of which is connected through resistor 74 and diode 76 to capacitor 60.

A light-emitting diode 78 and resistor 79 are connected across the primary winding 26 of step-down transformer 28 to indicate when groover blade 32 is energized. The light-emitting diode pulses in synchronism with the power supplied to the groover blade 32 and provides an indication that the blade is being heated.

In the operation of the circuit, when electrical power is first applied to terminals 12, there is no current in the base of transistor 50, and transistor 50 is consequently cut off. This allows the voltage at the collector of transistor 50 to increase with the first 120 Hz. pulse in line 16. Bidirectional diode 52 triggers transistor 36, and oscillation at 25 KHz. begins and takes place throughout the 1/120th second duration of the first pulse. Oscillation continues for subsequent pulses.

If, for any reason, current to the groover blade 32 becomes excessive, the current in resistor 38 causes the voltage drop across resistor 38 to increase. Current is supplied through resistor 66 and blocking diode 68, charging capacitor 60 to a voltage sufficient to turn on transistor 50 through the divider consisting of resistors 62 and 64. Turning on of the transistor 50 causes the trigger pulses to terminate. Thus, the number of consecutive trigger pulses varies depending on the extent to which the current in the groover blade exceeds a desired level. A similar result occurs when an overvoltage condition exists at transformer winding 72. Variable resistor 70, which is used to control the groover blade temperature, supplies current through a resistor 74 and diode 76, also charging capacitor 60.

Capacitor 60 is discharged continuously through resistors 62 and 64. Consequently it tends to seek an equilibrium level which depends not only on the setting of variable resistor 70, but also on the near-term past history of the operation of transistor 34. If variable resistor 70 is set to deliver more current through resistor 74 and diode. 76, capacitor 60 will charge to a higher level and tend to cut off transistor 50. When the condition of transistor 50 is no longer such as to support triggering of transistor 36 through bidirectional diode 52, one or more of the 120 Hz pulses will be skipped. Oscillation will resume, however, because capacitor 60 will no longer be charged through resistors 66 and 74 and will discharge through resistors 62 and 64 so that transistor 50 goes toward cutoff.

Figure 2:
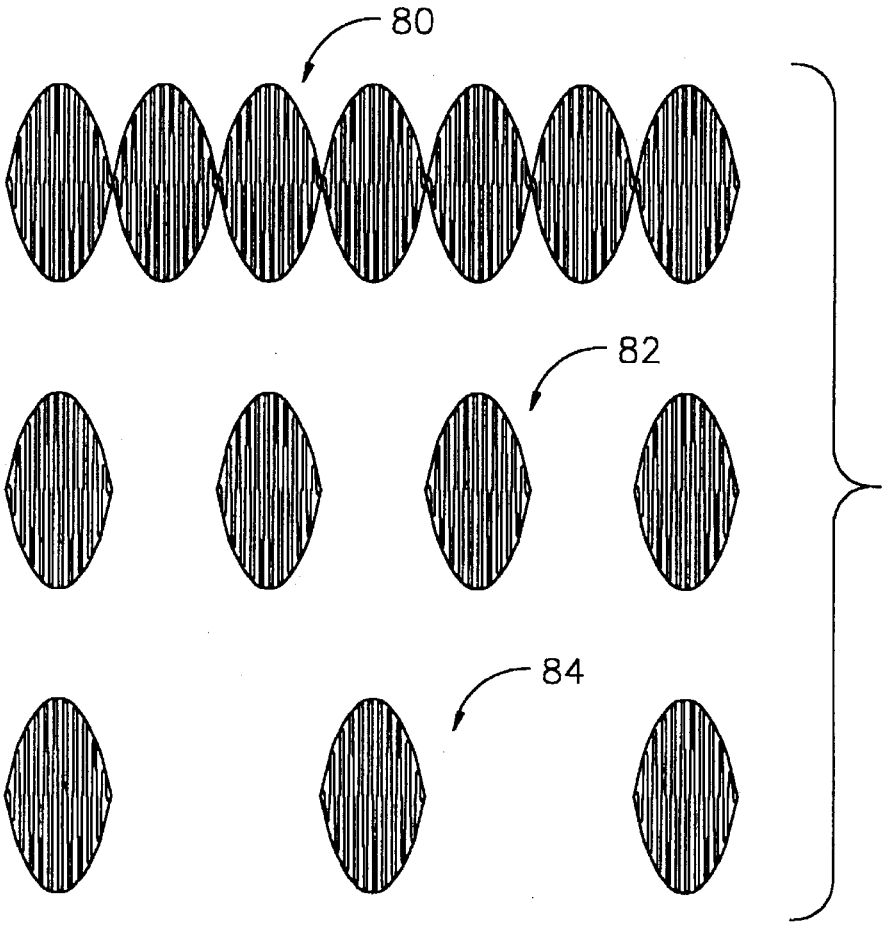
FIG. 2 is a diagram illustrating the voltage waveform across the heated blade in FIG. 1.

The circuit produces an output in the heating blade 32 which is essentially a 25 KHz. signal modulated by 120 Hz. pulses which are either present, or missing altogether. As shown in FIG. 2, group 80 of pulses is continuous, whereas in group 82, the 25 KHz. oscillator is operated only for every other 120 Hz. pulse, and in group 84, the oscillator is operated only for every third 120 Hz. pulse. It is possible to adjust variable resistor 70 to produce pulses of modulated 25 KHz. oscillations throughout the range of 120 pulses per second to less than pulse per second. Therefore, the temperature of the heating blade can be adjusted through a wide range.

In the circuit of FIG. 1, the feedback through both feedback circuits stabilizes the repetition rate of the pulses in the heating blade. The feedback through resistor 74 not only allows for adjustment of the repetition rate of the pulses, but also compensates for line voltage variations.

As will be apparent from the foregoing description, the entire circuit is light in weight, there being no need for a heavy step-down transformer capable of handling heavy currents at 60 Hz. Thus, the entire circuit can be incorporated into the hand-held hot groover unit, and the need for a belt-carried control and belt-carried transformer is eliminated. The control circuit allows for accurate control of temperature of the heating blade, to produce high quality grooves, bevels and the like in insulation materials.

Various modifications can be made to the apparatus described. For example, other forms of oscillator circuits, such as multivibrators, can be used instead of the complementary transistor circuit specifically described. Although a full wave bridge rectifier is preferred to convert line current to a series of sinusoidal pulses, half-wave rectification can be used.

The invention is particularly useful in the context of a hot groover, where the operator is in particular need of a light-weight, portable tool capable of being operated while moving about a job site. However the invention is also applicable to heating tools other than groovers, e.g. portable, electrically operated soldering tools.

Other modifications and applications, which will occur to persons skilled in the art, may be made without departing from the scope of the invention as defined in the following claims.

I claim:

1. A hand-held heating tool comprising:

a resistive heating element;

means for receiving alternating line current at a first frequency;

means, comprising an oscillator connected to the line current receiving means and to the resistive heating element, for producing an alternating current in the resistive heating element at a second frequency higher than the first frequency; and delivery and control means for causing the oscillator to deliver to the heating element a sequence of electrical pulses, each pulse consisting of plural oscillations at the second frequency, and for adjusting the time intervals between the pulses to control the electrical energy dissipated by the resistive heating element and thereby control the temperature of the heating element;

in which the means for receiving the line current comprises rectification means connected to receive said line current and producing a series of sinusoidal pulses at a repetition rate which is at least equal to the frequency of the line current, in which the oscillator is a non-self triggering oscillator connected to receive the series of sinusoidal pulses, the oscillator being responsive to a trigger pulse and beginning oscillation to produce alternating current at said second frequency only upon receipt of a trigger pulse during the duration of a sinusoidal pulse of the series and continuing to produce said alternating current only until the termination of the sinusoidal pulse during which the trigger pulse was received, and in which the delivery and control means comprises means for producing trigger pulses for triggering the oscillator, the delivery and control means being capable of producing trigger pulses during selected sinusoidal pulses, thereby the oscillator is capable of oscillating during some of the sinusoidal pulses of the series and capable of remaining idle during other sinusoidal pulses of the series.

2. A hand-held heating tool according to claim 1 in which the means for producing trigger pulses comprises capacitive means for storing a charge, trigger means responsive to the charge in the capacitive means for delivering the trigger pulses to the oscillator during a sinusoidal pulse of said series if the charge on the capacitive means is within a predetermined range, and means for adjusting the level of charge in said capacitive means.

3. A hand-held heating tool according to claim 2 including negative feedback means, responsive to the operation of the oscillator, for adjusting the charge in said capacitive means to stabilize the electrical energy dissipated by the resistive heating element and thereby stabilize the temperature of the heating element.

4. A hand-held heating tool according to claim 3 in which the means, comprising an oscillator connected to the line current receiving means and to the resistive heating element, includes a transformer having a primary winding connected to the oscillator, a first secondary winding connected to the resistive heating element, a second secondary winding, diode means connecting the second secondary winding to the capacitive means, whereby an increase in the voltage in the primary winding results in an increase in the charge on the capacitive means, and variable resistive means for adjusting the rate at which the capacitive means is charged.

5. A hand-held heating tool comprising:

a resistive heating element;

means for receiving alternating line current at a first frequency;

mean, comprising an oscillator connected to the line current receiving means and to the resistive heating element, for producing an alternating current in the resistive heating element at a second frequency higher than the first frequency; and delivery and control means for causing the oscillator to deliver to the heating element a sequence of electrical pulses, each pulse consisting of plural oscillations at the second frequency, and for adjusting the time intervals between the pulses to control the electrical energy dissipated by the resistive heating element and thereby control the temperature of the heating element;

in which the means for receiving the line current comprises full-wave rectification means connected to receive said line current and producing a continuous series of sinusoidal pulses at a repetition rate which is twice the frequency of the line current, in which the oscillator is a non-self triggering oscillator connected to receive the continuous series of sinusoidal pulses, the oscillator being responsive to a trigger pulse and beginning oscillation to produce alternating current at said second frequency only upon receipt of a trigger pulse during the duration of a sinusoidal pulse of the series and continuing to produce said alternating current only until the termination of the sinusoidal pulse during which the trigger pulse was received, and in which the delivery and control means comprises means for producing trigger pulses for triggering the oscillator, the delivery and control means being capable of producing trigger pulses during selected sinusoidal pulses, whereby the oscillator is capable of oscillating during some of the sinusoidal pulses of the series and capable of remaining idle during other sinusoidal pulses of the series.

6. A hand-held heating tool according to claim 5 in which the means for producing trigger pulses comprises capacitive means for storing a charge, trigger means responsive to the charge in the capacitive means for delivering the trigger pulses to the oscillator during a sinusoidal pulse of said series if the charge on the capacitive means is within a predetermined range, and means for adjusting the level of charge in said capacitive means.

7. A hand-held heating tool according to claim 6 including negative feedback means, responsive to the operation of the oscillator, for adjusting the charge in said capacitive means to stabilize the electrical energy dissipated by the resistive heating element and thereby stabilize the temperature of the heating element.

8. A hand-held heating tool according to claim 7 in which the means, comprising an oscillator connected to the line current receiving means and to the resistive heating element, includes a transformer having a primary winding connected to the oscillator, a first secondary winding connected to the resistive heating element, a second secondary winding, diode means connecting the second secondary winding to the capacitive means, whereby an increase in the voltage in the primary winding results in an increase in the charge on the capacitive means, and variable resistive means for adjusting the rate at which the capacitive means is charged.

* * * * *